US009061477B2

(12) United States Patent
Chandaria

(10) Patent No.: US 9,061,477 B2
(45) Date of Patent: Jun. 23, 2015

(54) METHOD AND APPARATUS FOR MAKING, SHIPPING AND ERECTING BOXES

(75) Inventor: Kapoor Chandaria, Nairobi (KE)

(73) Assignee: Kitaru Innovations Inc., Lascelles, St. James (BB)

( * ) Notice: Subject to any disclaimer, the term of this patent is extended or adjusted under 35 U.S.C. 154(b) by 974 days.

(21) Appl. No.: 12/551,617

(22) Filed: Sep. 1, 2009

(65) Prior Publication Data

US 2010/0001056 A1 Jan. 7, 2010

Related U.S. Application Data

(63) Continuation-in-part of application No. 11/955,519, filed on Dec. 13, 2007, now Pat. No. 7,614,992.

(51) Int. Cl.

| | |
|---|---|
| ***B31B 1/26*** | (2006.01) |
| ***B31B 1/88*** | (2006.01) |
| ***B65D 5/36*** | (2006.01) |
| ***B65D 5/42*** | (2006.01) |
| *B65B 61/24* | (2006.01) |

(52) U.S. Cl.

CPC ..... *B31B 1/88* (2013.01); *Y10T 29/49826* (2015.01); *B31B 2201/88* (2013.01); *B65D 5/3621* (2013.01); *B65D 5/4266* (2013.01)

(58) Field of Classification Search

USPC ..... 53/441, 131.2–131.4; 705/60; 229/101, 229/125, 183; 493/162, 183

See application file for complete search history.

(56) References Cited

U.S. PATENT DOCUMENTS

| | | | | |
|---|---|---|---|---|
| 1,765,104 A | | 6/1930 | Shearer | |
| 2,718,348 A | | 9/1955 | Montfort | |
| 2,783,933 A | | 3/1957 | Sharts | |
| 2,936,239 A | * | 5/1960 | Rendall | 53/467 |
| 2,967,655 A | | 1/1961 | Seger, Jr. | |
| 3,373,919 A | | 3/1968 | Schaich | |
| 3,727,827 A | * | 4/1973 | Stice | 229/101 |
| 4,012,996 A | * | 3/1977 | Stolkin et al. | 493/142 |
| 4,019,673 A | | 4/1977 | Salomons | |
| 4,059,221 A | | 11/1977 | Olson et al. | |
| 4,887,766 A | | 12/1989 | Schoeneweis | |

(Continued)

FOREIGN PATENT DOCUMENTS

| | | |
|---|---|---|
| EP | 0054275 | 4/1985 |
| EP | 1015353 | 11/2006 |

(Continued)

OTHER PUBLICATIONS

Practical Ecommerce; "Shipping Rates: Flat Rate Boxes Usually Save Money"; Aug. 31, 2009; pp. 1-3.*

(Continued)

*Primary Examiner* — Gloria R Weeks

(74) *Attorney, Agent, or Firm* — Sand & Sebolt

(57) ABSTRACT

A cardboard box with four side panels, four bottom flaps and four top flaps. The box is made from a blank having a first height measured between the outermost edges of the top and bottom flaps. The flaps are rotated into abutting contact with the exterior surface of the panels thereby reducing the overall height of the box to the height of the panel. Adjacent pairs of top and bottom flaps are provided with living hinges that enable them to remain in this position when the box is collapsed. The collapsed box is shipped through the mail in this diminished size and then erected into a box of the same height as the panels.

28 Claims, 16 Drawing Sheets

(56) References Cited

U.S. PATENT DOCUMENTS

| | | | | |
|---|---|---|---|---|
| 5,148,940 | A | 9/1992 | Mendise | |
| 5,429,295 | A | 7/1995 | Levy | |
| 5,476,218 | A | 12/1995 | Reisman | |
| 5,752,650 | A | 5/1998 | Henderson | |
| 5,934,549 | A | 8/1999 | Baumgartner et al. | |
| 5,934,579 | A | 8/1999 | Hiersche et al. | |
| 6,119,929 | A | 9/2000 | Rose | |
| 6,676,009 | B1 | 1/2004 | Rose | |
| 6,701,304 | B2 * | 3/2004 | Leon | 705/401 |
| 6,918,503 | B1 | 7/2005 | Molander | |
| 6,926,153 | B2 | 8/2005 | Chandaria | |
| 6,939,063 | B2 * | 9/2005 | Bussell | 400/103 |
| 7,065,492 | B2 * | 6/2006 | Cinquini et al. | 705/60 |
| 7,136,830 | B1 | 11/2006 | Kuelbs et al. | |
| 7,614,992 | B2 * | 11/2009 | Chandaria | 493/55 |
| 7,831,518 | B2 * | 11/2010 | Montgomery et al. | 705/62 |
| 8,086,344 | B1 * | 12/2011 | Mishra et al. | 700/216 |
| 8,590,774 | B1 * | 11/2013 | Sauer | 229/239 |
| 2005/0241978 | A1 | 11/2005 | Plue et al. | |
| 2008/0004931 | A1 | 1/2008 | Kambs et al. | |
| 2008/0133305 | A1 | 6/2008 | Yates et al. | |
| 2008/0208717 | A1 | 8/2008 | Suleymanov | |
| 2008/0294477 | A1 | 11/2008 | Lore et al. | |
| 2008/0301009 | A1 | 12/2008 | Plaster et al. | |
| 2009/0094082 | A1 | 4/2009 | Willoughby | |
| 2009/0184160 | A1 | 7/2009 | Nudd | |
| 2010/0078466 | A1 * | 4/2010 | Stack et al. | 229/120.38 |
| 2011/0108450 | A1 * | 5/2011 | Goodrich | 206/521 |
| 2011/0114535 | A1 | 5/2011 | Pearson et al. | |

FOREIGN PATENT DOCUMENTS

| | | |
|---|---|---|
| GB | 2217300 | 10/1999 |
| WO | WO 2007/058613 | 5/2007 |

OTHER PUBLICATIONS

US Air Force; "Postal Service Offers First Time Military Discount"; http://www.af.mil/News/ArticleDisplay/tabid/223/Article/124405/postal-service-offers-fir; Feb. 7, 2008; pp. 1-2.*

* cited by examiner

METHOD AND APPARATUS FOR MAKING, SHIPPING AND ERECTING BOXES

CROSS-REFERENCE TO RELATED APPLICATIONS

This is a Continuation-in-Part of U.S. patent application Ser. No. 11/955,519, filed Dec. 13, 2007, the entire specification of which is incorporated herein by reference.

BACKGROUND OF THE INVENTION

1. Technical Field

The invention relates generally to shipping and storage boxes. More particularly, the invention relates to cardboard boxes which are shipped in a flat configuration and are erected at the time of use. Specifically, the invention relates to a box in which the top and bottom flaps are retained in abutting contact with the side panels by living hinges when the box is shipped to a first consumer.

2. Background Information

Various types of boxes exist which may be manufactured of any flat material such as cardboard, and which are configured to efficiently fold into the final box shape. As people move about the country and the world, it becomes ever evident that the need for individuals to purchase and utilize storage and shipping boxes is ever increasing. Additionally, with the advent of e-commerce and more specifically the advent of online sites that permit people to purchase goods from remote sellers after bidding on the same over the Internet, there is a need for companies that conduct such e-commerce to send shipping boxes to their sellers for boxing up of the sold goods. However, presently known cardboard boxes, even when shipped, stored or displayed in a flattened, unassembled configuration tend to take up a significant amount of space. This is especially problematic if such flattened, unassembled boxes are to be forwarded to sellers through the regular postal service.

Cardboard cartons or boxes which are purchased in a flattened position and are assembled for manual loading generally include a plurality of flaps which extend upwardly into the air from a top edge of the sidewall panels. These flaps can be cumbersome to work around when loading the box. Various box configurations have been proposed in the prior art to try and deal with this problem. For example, U.S. Pat. No. 2,718,348 to Monfort, discloses a box having four sidewall panels joined together along four fold lines. The box includes top and bottom flaps that extend respectively outwardly from the top and bottom edges of those sidewall panels. Some of the top flaps are secured to each other by a bridging member on the respective fold line. The box is shipped in a first collapsed position where the top flaps and bottom flaps are coplanar with the sidewall panels and extend outwardly away from the top and bottom edges thereof. The bridging members between some of the top flaps are positioned on the folds that form the outer corners of the collapsed box. A pair of diametrically opposed folds fall intermediate these outer corners. The top flaps are not connected together by bridging members along these intermediate folds. When it is time for the box to be erected, it is manipulated into a second collapsed position where the folds with the bridging members are moved to a position intermediate the outer corners. When in this second position, the top flaps are not connected by bridging members at the outer corners. This arrangement permits the assembler to fold the top flaps downwardly from their shipping position into a position where the exterior surface of each flap is in abutting contact with the exterior surface of one of the sidewall panels. The box is then opened up and the bottom flaps are used to close the bottom opening of the box. The exterior surfaces of the top flaps remain in abutting contact with the exterior surfaces of the sidewall panels. Consequently, the top flaps do not interfere with the loading of goods into the box's interior. When the box is fully loaded, the bridging members are broken and the top flaps are rotated to a position where they may be used to close off access to the interior of the box.

U.S. Pat. No. 2,783,933 to Sharts discloses a similar arrangement where diametrically opposed folds include bridging members on the top flaps. Once again, the collapsed box is shipped with the top and bottom flaps coplanar with the sidewall panels and extending outwardly away from the top and bottom edges thereof. The bridging members are positioned on the folds that fall intermediate the outer corners of the collapsed box. The top flaps are not connected together by bridging members at the outer corners. Consequently, the box does not have to be moved from a first collapsed position to a second collapsed position, as was the case with the Montfort box, before folding the top flaps downwardly into abutting contact with the exterior surface of the sidewall panels. After purchasing the box, the consumer simply folds the top flaps from their shipping position into a loading position where the exterior surface of each of the top flaps is in abutting contact with the exterior surface of one of the sidewall panels. The box is opened up and the bottom flaps are rotated into a position where they close off access to the bottom of the box. The bridging members between some of the top flaps are broken once the box is loaded. The top flaps are then rotated out of contact with the exterior surfaces of the sidewall panels and into a position where they close off access to the box's interior.

U.S. Pat. No. 3,727,827 to Stice discloses a variable size container. Each of the adjacent pairs of the top and bottom flaps on Stice's box is connected together by a bridging member. The box is provided with a plurality of additional horizontal and vertical fold lines in various positions. This permits a variety of differently shaped and sized containers to be constructed from a single blank. The box is shipped to the end consumer in a collapsed position with the top and bottom flaps coplanar with the sidewall panels and extending outwardly away from the top and bottom edges thereof. In this instance, the top flaps are not folded downwardly into abutting contact with the exterior surface of the sidewall panels. Instead, the consumer folds the box along selected horizontal and vertical fold lines to make up the size and shape container they need. The bridging members that fall on the outer corners of the eventually constructed box are broken so that the top and bottom flaps can be rotated into a suitable position to close the box.

Rendall (U.S. Pat. No. 2,936,239) discloses a box with bridging members between each pair of top flaps. The box is shipped in a collapsed position with the top and bottom flaps coplanar with the sidewall panels. When the box reaches the consumer, they manipulate it into an open position and then rotate the bottom flaps to a position where they close off access to the bottom of the box. The top flaps may be left extending upwardly from the sidewall panels and the box may be used as an open top container. Alternatively, the bridging members between the top flaps may be broken and the top flaps may be rotated to close off the top of the box.

All of the above patents disclose that the box blank is shipped to the consumer in a position where the top and bottom flaps are coplanar with the sidewall panels and extend outwardly away from the top and bottom edges thereof. Consequently, the shipping size of all of these boxes is fairly large.

Therefore, the need exists in the art for a box which takes up less space when it is in a flattened, unassembled configuration and which is able to fit within the confines of a standard-size postal carrier's delivery bag, and which may be easily assembled by the user once received or purchased.

BRIEF SUMMARY OF THE INVENTION

The device of the present invention comprises a box that has four side panels, four bottom flaps and four top flaps. The box is made from a blank having a first height measured between the outermost edges of the top and bottom flaps. The flaps are rotated into abutting contact with the exterior surface of the panels thereby reducing the overall height of the box to the height of the panel. Adjacent pairs of top and bottom flaps are provided with living hinges that enable them to remain in this position when the box is collapsed. The collapsed box is shipped through the mail in this diminished size and then erected into a box of the same height as the panels. Thus, the box is of a height that is substantially equal to the height of a sidewall panel when in each of a shipping position, erected position and storage position.

A shipping label is applied to an interior surface of one of the top and bottom flaps and includes a shipping address for mailing of the collapsed box to a first consumer. When the box is fully erected, the shipping label is moved to an interior of the box as the one of the top and bottom flaps is rotated to close off access to the interior of the box. Additionally, the box includes a mailing label that is applied to an exterior surface of one of the panels, top and bottom flaps in a region that is not visible when the box is in a collapsed position. When the box is erected, the mailing label becomes visible and a mailing address of a second consumer made be written thereon. Similarly, a prepaid postage decal is applied to an exterior surface of one of the panels, top and bottom flaps in a region that is not visible when the box is in a collapsed position but becomes visible when the box is fully erected. The mailing label with the mailing address and the prepaid postage decal is used when the fully erected and loaded box is mailed on to a second consumer by the first consumer.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
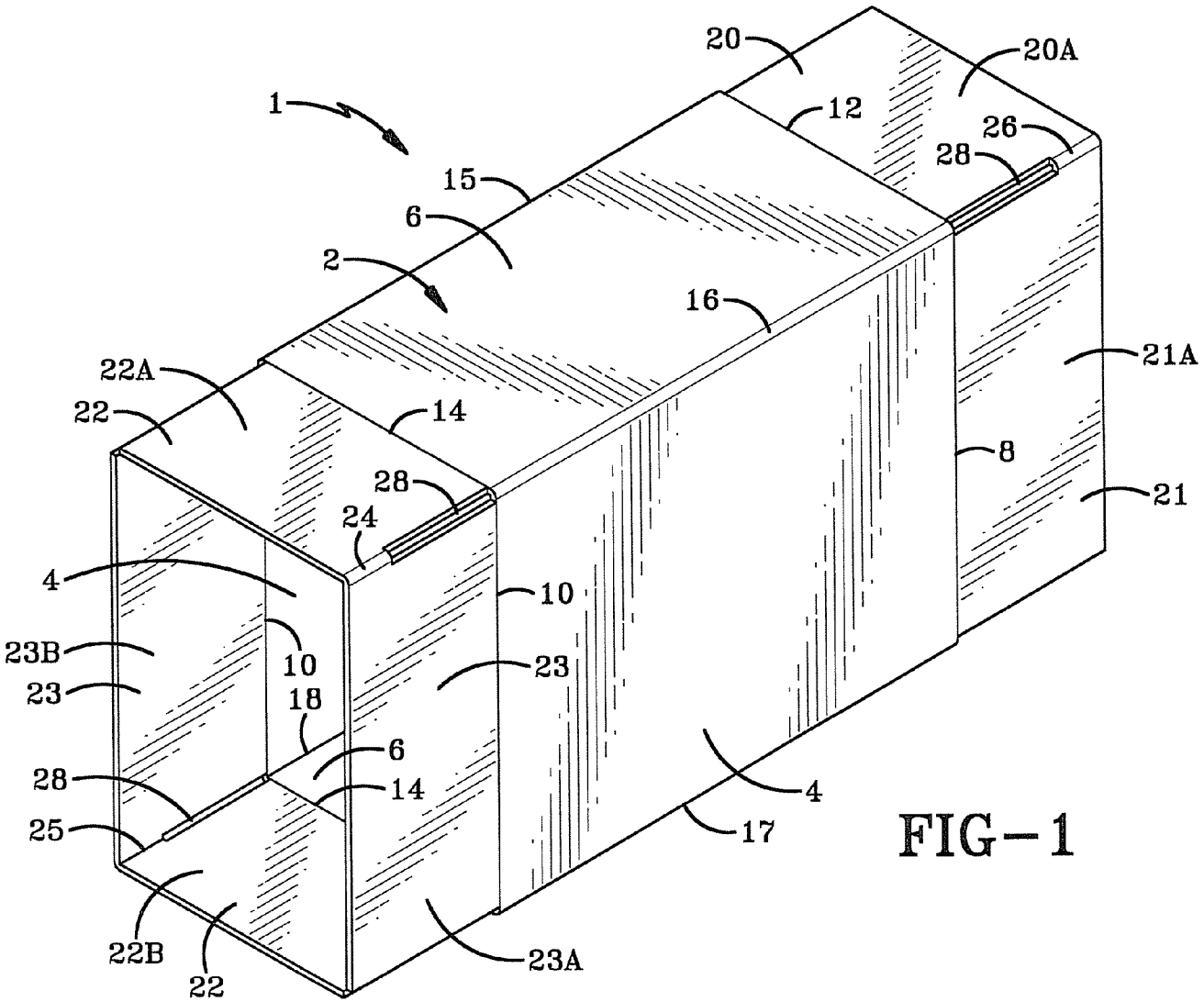
FIG. 1 is a perspective view of the box of the present invention.
Figure 1A:
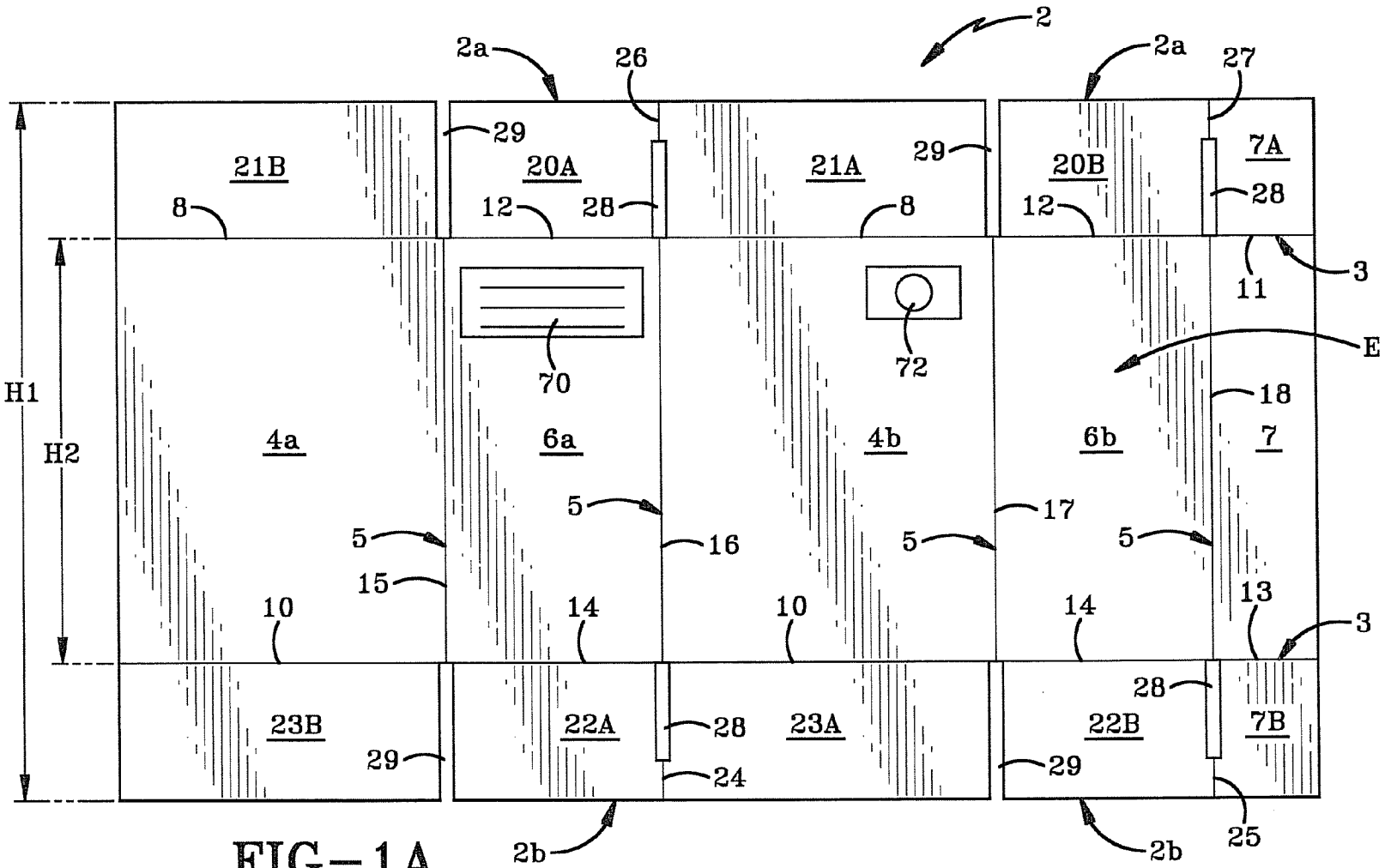
FIG. 1A is a plan view of a blank used to form the box of the present invention and showing the exterior surface thereof.
Figure 1B:
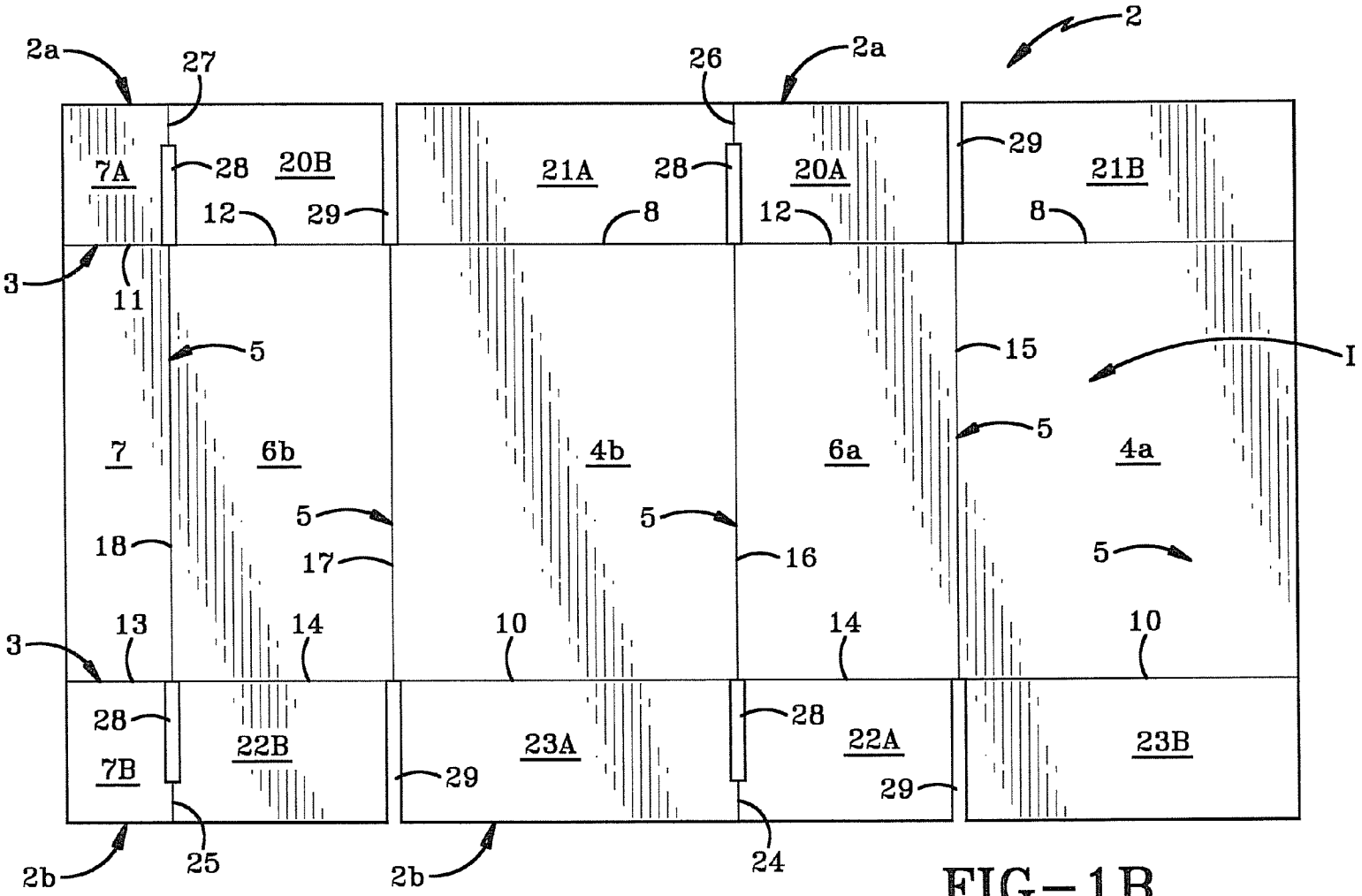
FIG. 1B is a plan view of the blank of FIG. 1A showing the interior surface thereof.
Figure 2:
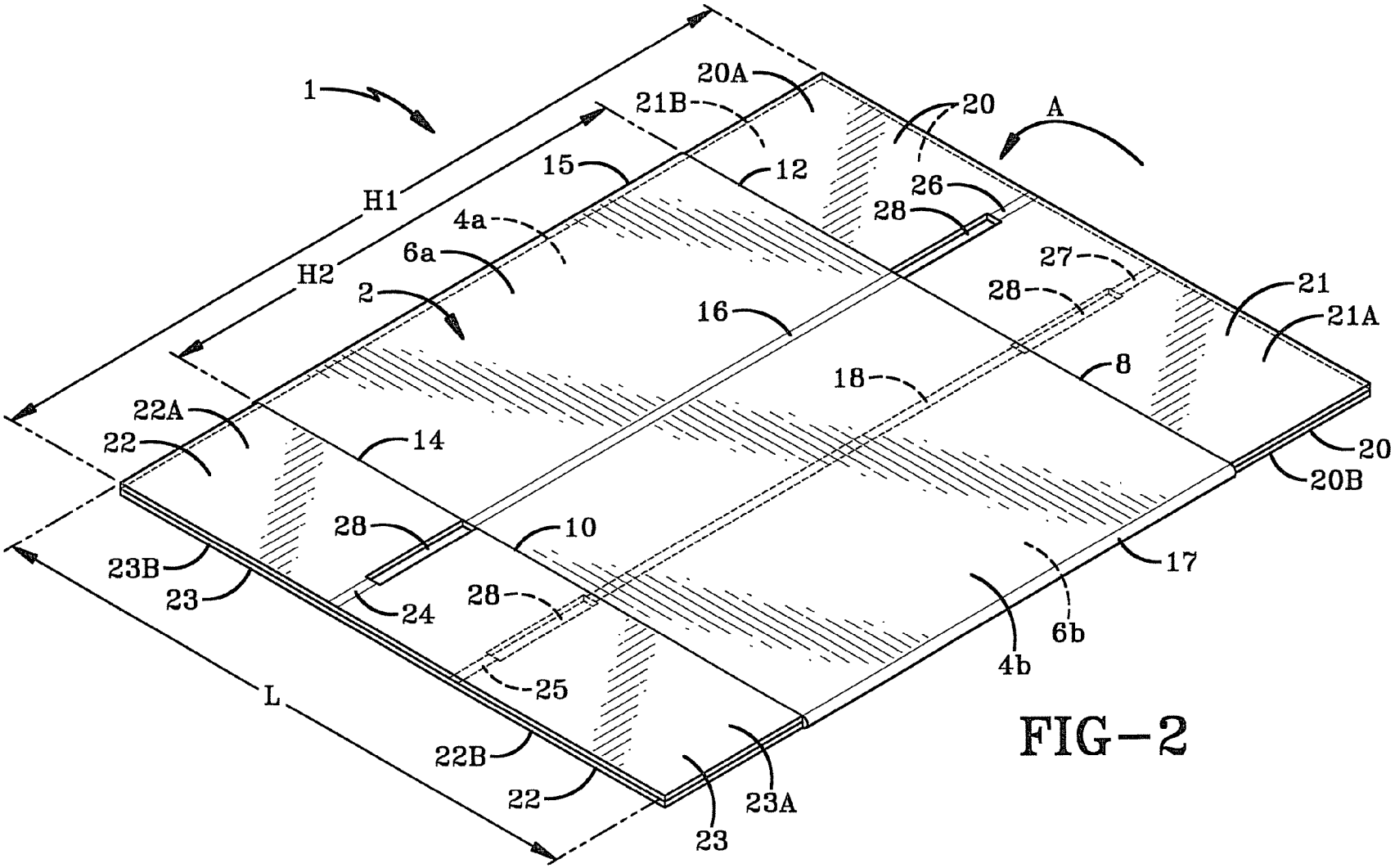
FIG. 2 is a perspective view of the box shown in FIG. 1 in a collapsed configuration.
Figure 3:
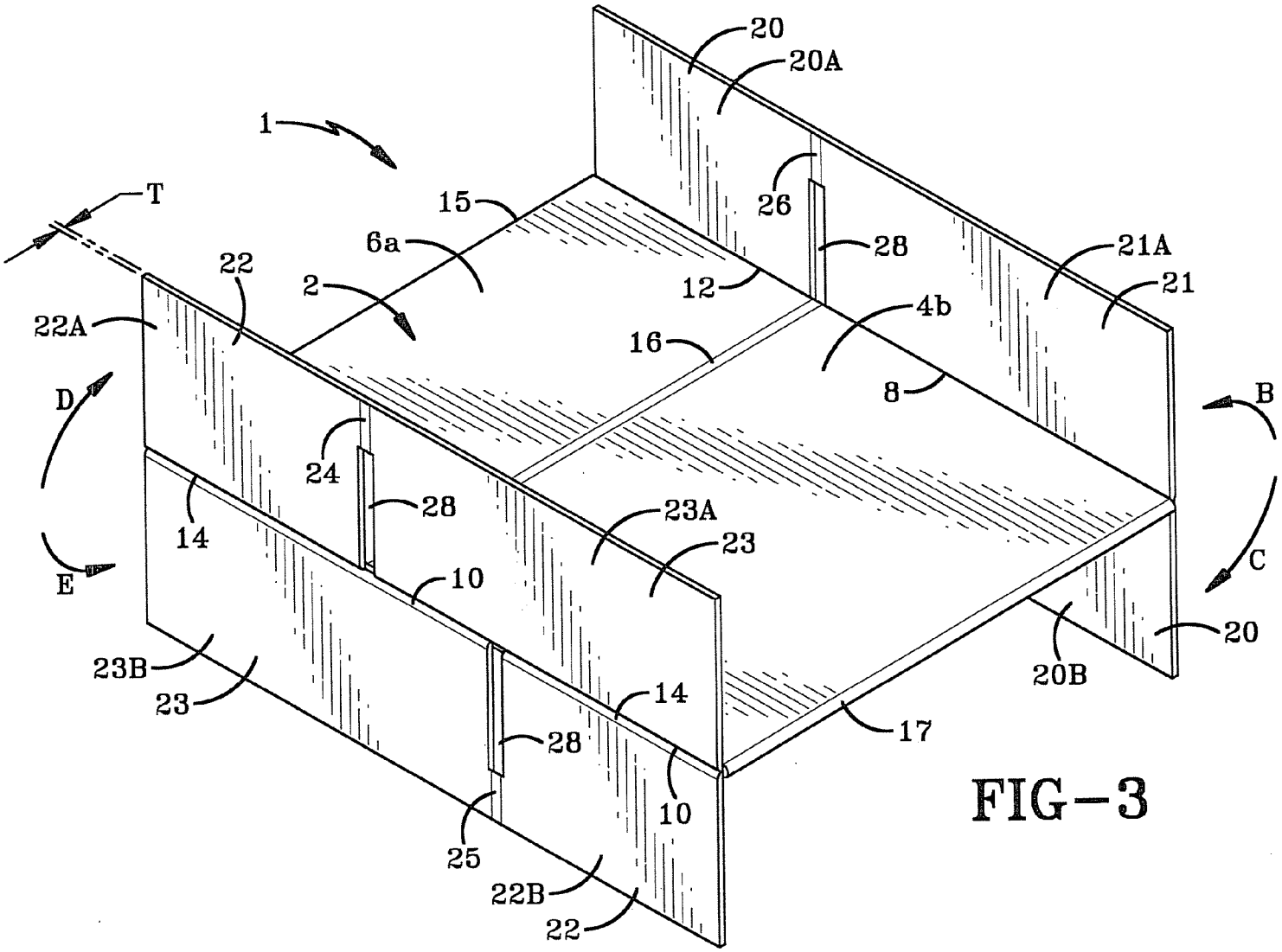
FIG. 3 is a perspective view of the box shown in FIG. 1 with the flaps moved to a second position.

The storage and shipping box of the present invention is indicated generally at the numeral 1, and is shown specifically in FIGS. 1-12. FIGS. 1A and 1B show a blank 2 that is used to construct the box 1. Blank 2 is a planar sheet of material that preferably is of a uniform thickness "T" (FIG. 3). FIG. 1A shows the exterior surface "E" of blank 2 and FIG. 1B shows the interior surface "I" of blank 2. As is well-known in the art, blank 2 may be made of a variety of materials including corrugated cardboard, non-corrugated paperboard, or a variety of wax-coated products including paper and plastic.

In accordance with a specific feature of the present invention, blank 2 includes a plurality of foldlines that are used to erect box 1. Blank 2 preferably is provided with two horizontally oriented and spaced-apart foldlines 3 and four vertically oriented and spaced-apart foldlines 5. It will be understood, however, that other arrangements and numbers of foldlines 3, 5 may be provided to construct boxes of different shapes to that shown in FIG. 1. Foldlines 5 divide blank 2 into a first panel 4*a*, a second panel 6*a*, a third panel 4*b*, a fourth panel 6*b*, and a connector panel 7. Foldlines 3 form a top edge and bottom edge for each of the panels 4*a* through 6*b* and separate them from a top flap and a bottom flap, respectively. First panel 4*a* has a top edge 8 with a top flap 21B extending outwardly away therefrom and a bottom edge 10 with a bottom flap 22B extending outwardly away therefrom. It will be understood that top and bottom edges 8, 10 are disposed along the spaced apart foldlines 3. It should further be understood that top and bottom flaps 21B, 22B are substantially coplanar with first panel 4*a* before the construction of box 1 is initiated.

Second panel 6*a* has a top edge 12 with a top flap 20A extending outwardly away therefrom and a bottom edge 14 with a bottom flap 22A extending outwardly away therefrom. Top and bottom edges 12, 14 are disposed along foldlines 3 and top and bottom flaps 20A, 22A are substantially coplanar with second panel 6*a*. First panel 4*a* is separated from second panel 6*a* by a joint 15 that is disposed along one of foldlines 5. It should be noted that a gap 29 exists between top flaps 21B and 20A and between bottom flaps 22B and 22A. These gaps 29 extend substantially from the foldlines 3 to the respective outermost edges 2*a* or 2*b* of blank 2.

Third panel 4*b* has a top edge 8 with a top flap 21A extending outwardly away therefrom, and a bottom edge 10 with a bottom flap 23A extending outwardly away therefrom. Once again, top and bottom edges 8, 10 are disposed along the spaced apart foldlines 3 and top and bottom flaps 21AB, 23A are substantially coplanar with third panel 4*b*. Third panel 4*b* is separated from second panel 6*a* by a joint 16 that falls on another of foldlines 5. In accordance with a specific feature of the present invention, top flaps 20A, 21A are partially separated from each other by a gap 28 while a hinge 26 connects a portion of the top flaps 20A, 21A together. Hinge 26 originates a distance outwardly away from foldline 3 and continues to the outermost edge 2*a* of blank 2. Similarly, a portion of bottom flap 22A is separated from a portion of bottom flap 23A by a gap 28 while a hinge 24 connects another portion of flaps 22A, 23A together. Hinge 24 originates a distance outwardly away from foldline 3 and continues to outermost edge 2*b* of blank 2.

Fourth panel 6*b* has a top edge 12 with a top flap 20B extending outwardly away therefrom and a bottom edge 14 with a bottom flap 23B extending outwardly away therefrom. Top and bottom edges 12, 14 are disposed along foldlines 3 and top and bottom flaps 20B, 23B are substantially coplanar with fourth panel 6*b*. Fourth panel 6*b* is separated from third panel 4*b* by a joint 17 that falls along another of vertical foldlines 5. A gap 29 is defined between each of top flaps 21A, 20B and bottom flaps 23A, 23B. Gaps 29 extend substantially from the foldline 3 to the respective outermost edge 2*a*, 2*b* of blank 2. Consequently, top flaps 21A, 20B are not connected to each other and bottom flaps 23A, 23B are not connected together.

As is apparent from a review of the present invention, hinges 24 -27 may simply be manufactured of the same material and be integrally formed with blank 2. In this instance, hinges 24-27 are of the same thickness "T" as the rest of the material used in blank 2 and therefore may need to be cut with a knife or other implement in order to break the same. It will be understood that hinges 24-27 could, alternatively, be manufactured out of material with a reduced thickness relative to the rest of the blank, or could be made with a fracture line formed therein to make breaking the hinge easier. It will further be understood that hinges 24-27 may all be of different lengths. This is accomplished by increasing or decreasing the length of gaps 28.

Connector panel 7 has a top edge 11 and a bottom edge 13 that are disposed along the respective foldlines 3. A top connector flap 7A extends outwardly away from top edge 11 and a bottom connector flap 7B extends outwardly away from bottom edge 13. Top and bottom connector flaps 7A, 7B are substantially coplanar with connector panel 7. Connector panel 7 is separated from fourth panel 6*b* by a joint 18 that falls on another of foldlines 5. In accordance with a specific feature of the present invention, a portion of top flap 20B is separated from a portion of top connector flap 7A by a gap 28. A hinge 27 connects other portions of these flaps 20B, 7A together. Hinge 27 originates a distance outwardly from the associated foldline 3 and continues to the outermost edge 2*a* of blank 2. Similarly, a portion of bottom flap 22B is separated from a portion of bottom connector flap 7B by a gap 28. A hinge 25 connects other portions of flaps 22B, 7B together. Hinge 25 originates a distance outwardly from the associated foldline 3 and continues to outermost edge 2*b* of blank 2.

FIG. 1A shows that the blank 2 has a first height H1 as measured between the outermost edges 2*a* and 2*b*. The panels are all of a second height H2 as measured between top and bottom edges 8, 10 and 12, 14. The second height H2 is smaller than the first height H1.

Figure 1C:
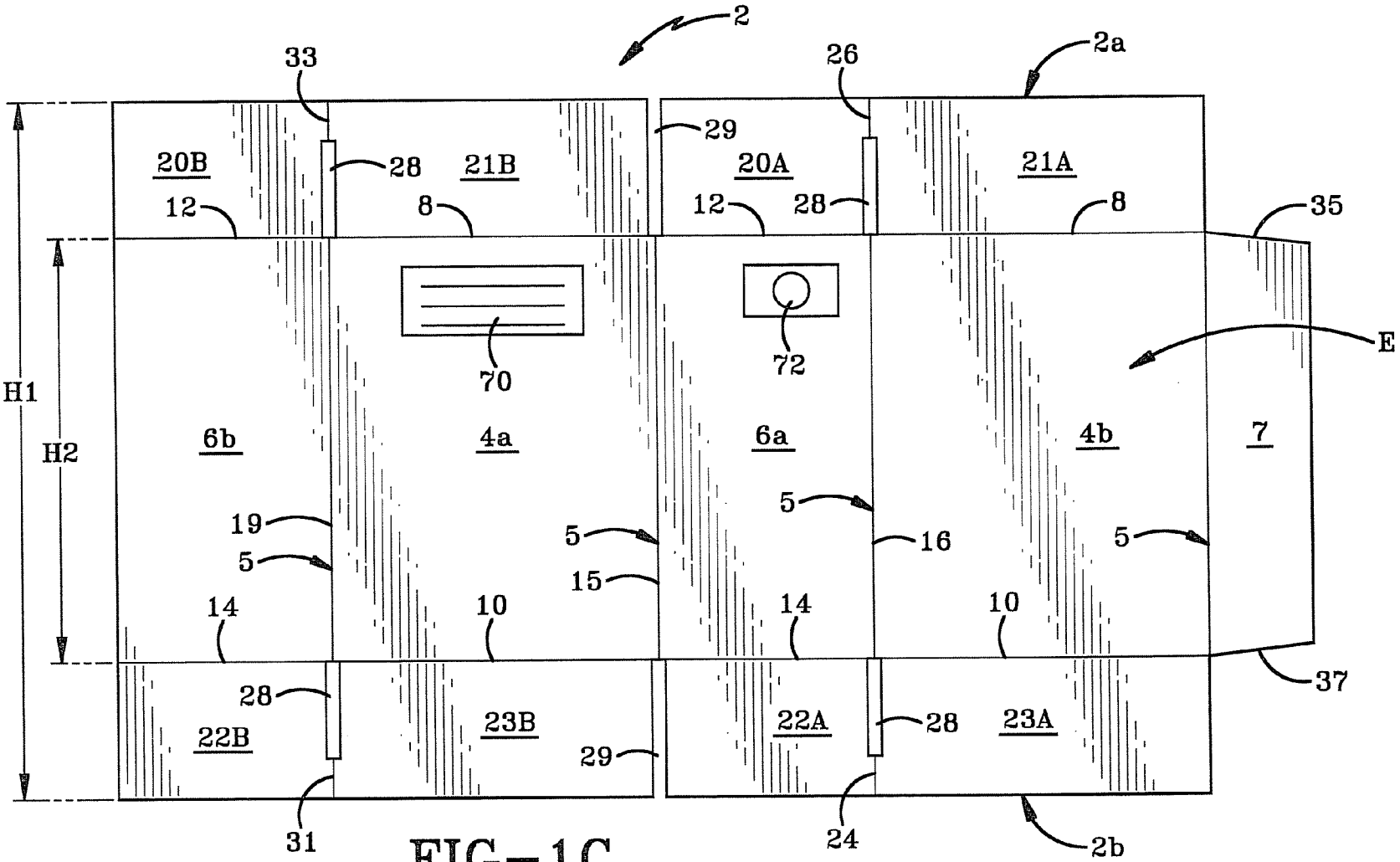
FIG. 1C is a plan view of an alternative blank used to form the box of the present invention and showing the exterior surface thereof.

FIG. 1C shows an alternative blank 2 that may be used to form box 1. The blank is substantially identical to the blank illustrated in FIGS. 1A and 1B except that the connector flap 7 does not have flaps 7A and 7B connected thereto. Instead, connector flap 7 has beveled edges 35, 37 and is of a height H2 as measured between edges 35, 37. Additionally, the fourth panel 6*b* is disposed adjacent the first panel 4*a* instead of being disposed between the third panel 4*b* and the connector panel 7 as was the case in the blank of FIG. 1A. In this version of the blank, the fourth panel 6*b* is separated from the first panel 4*a* by a joint 19. Furthermore, the flap 20B is connected to flap 21B by a hinge 33 and the flap 22*b* is connected to the flap 23B by a hinge 31. The box constructed from this blank is substantially identical in external appearance to the box constructed from the blank shown in FIGS. 1A and 1B. It will be understood that other modifications may be made to blank 2 without departing from the scope of the present invention.

In accordance with the present invention, a shipping address label 70 preferably is applied to exterior surface "E" of blank 2 before construction of the box 1 begins. Label 70 preferably includes a plurality of spaced apart horizontal lines that a consumer may use to write a shipping address. Label 70 may be printed directly onto the exterior surface "E" of blank 2 or may be an adhesive type label that is applied onto exterior surface "E".

In accordance with yet another specific feature of the present invention, a prepaid postage decal 72 is also applied to the exterior surface "E" of blank 2. The prepaid postage decal 72 represents a flat rate for mailing the erected and loaded box through the mail. This flat rate is a pre-negotiated rate with a postal service of any particular country or countries and is dependent upon the dimensions of the box once erected and upon the maximum permissible weight of the box once loaded. Preferably, the flat rate is not dependent upon the delivery address of the loaded box if delivered within a pre-negotiated region. For example, the flat rate may be a rate negotiated with either or both of the postal services of the United States and Canada for delivery of a box of particular dimensions and maximum weight anywhere within North America.

Decal 72 may be printed directly onto the exterior surface "E" or may be an adhesive label that is applied thereto. Both of the label 70 and decal 72 preferably are applied in regions of the blank 2 that are adjacent one of the top and bottom edges 8, 10, 12, 14 and which will be covered by one of the top and bottom flaps as will be hereinafter described when the blank 2 is folded.

When box 1 is erected, the panels and flaps are folded about these horizontal and vertical foldlines 3, 5 as will be hereinafter described. In the erected box panels 4*a* and 4*b* comprise a pair of opposed, substantially parallel and spaced apart sidewalls 4 and panels 6*a* and 6*b* comprise a pair of opposed, substantially parallel and spaced apart endwalls 6. The top flaps 21B, 20A, 21A, and 20B are folded inwardly toward each other to close off access to a top opening in the box. The bottom flaps 22B, 22A, 23A, and 23B are folded inwardly toward each other to close off access to a bottom opening in the box.

It will be understood that hinges 24, 25, 26 and 27 may be of any of a variety of lengths without departing from the spirit of the present invention, but are preferably between ½ and 2 inches in length. Furthermore, while hinges 24, 25, 26 and 27 are shown as being located proximate the outermost edges 2*a*, 2*b*, they may be spaced a distance inwardly away therefrom without departing from the spirit of the present invention.

Blank 2 is erected into a box 1 in the following manner. The planar sheet of material that comprises blank 2 is folded about each of the foldlines 5. Blank 2 is folded along the foldline 5 between fourth panel 6*b* and connector panel 7 and the connector panel 7 is caused to overlap a portion of first panel 4*a*. This causes connector flap 7A to overlap a portion of top flap 21B and causes bottom connector flap 7B to overlap a portion of bottom flap 22B. An adhesive or other securing mechanism is applied between the overlapped areas to fixedly secure connector flap 7 to first panel 4*a*, top connector flap 7A to top flap 21B, and bottom connector flap 7B to bottom flap 22B. The blank 2 is then manipulated to fold along the appropriate foldlines 5 to form joints 15 and 17 (FIG. 2) and is oriented so that these joints 15,17 constitute the outermost corners of the blank 2. In order to do this, box 1 is moved from the position shown in FIG. 1 to the position shown in FIG. 2 by rotating box 1 in the direction of Arrow A (FIG. 2) and by flexing joints 15 and 17 to have a 180° bend associated therewith. Joints 16 and 18 are moved to a substantially flat configuration. In this first folded position (FIG. 2), hinges 24, 25, 26, and 27 are disposed in the region of the box that is intermediate the outer corners formed by joints 15 and 17. It will be understood that gaps 29 are oriented along joints 15, 17 and are therefore disposed along the outer corners when box 1 is in this first folded position. It should also be noted that at this point FIG. 2 illustrates the exterior surfaces of the box 1, and most specifically the exterior surfaces of second panel 6*a*, third panel 4*b* together with their top flaps 20A/21A and bottom flaps 22A/23A. If the box 1 were flipped over, then the exterior surfaces of the fourth panel 6*b* and the first panel 4*a* and their associated flaps 21B/22B and 20B/23B would be seen.

Once the box 1 is in the position shown in FIG. 2, then the top flaps 20A/21A, which are joined together by hinge 26, and the top flaps 20B/21B, which are joined together by hinge 27, are rotated along Arrows B and C, respectively, until they are in the position shown in FIG. 3. Similarly, bottom flaps 22A/23A, which are joined together by hinge 24, and bottom flaps 23B/22B, which are joined together by hinge 25, are rotated in the direction of Arrows D and E, respectively, until they are moved into the position shown in FIG. 3. As these joined flaps 20A/21A; 20B/21B and 22A/23A; 23B/22B continue to be rotated, they will ultimately move to the position shown in FIG. 4. In this position, the exterior surfaces of each of the joined top flaps 20A/21A and 20B/21B abut the exterior surface of the associated first, second, third and fourth panels. Consequently, when box 1 is in the position shown in FIG. 4, the interior surfaces of the flaps 20A/21A; 22A, 23A are visible. Similarly, if the box 1 were flipped over, the interior surfaces of flaps 20B/21B and 23B/22B would be visible.

Figure 4:
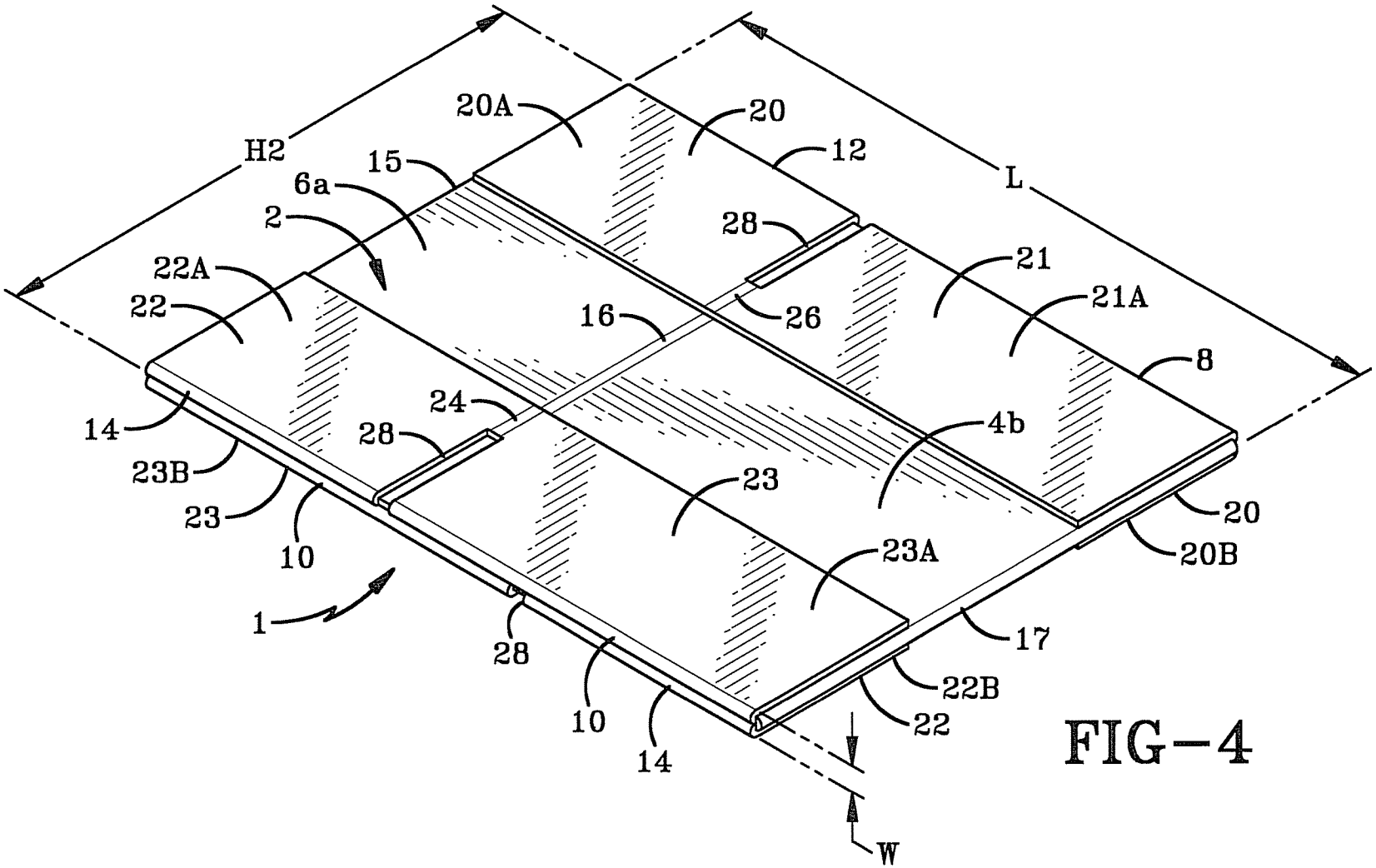
FIG. 4 is a perspective view of the box shown in FIG. 1 in a first collapsed position with the flaps collapsed against the body.

Referring particularly to FIG. 4, box 1 is shown in a first collapsed position with first hinge 24 and second hinge 26 aligned along joint 16 and where the joint is substantially flattened so that the second panel 6*a* is substantially coplanar with the third panel 4*b*. It will be understood that, similarly, third hinge 26 and fourth hinge 27 are aligned along joint 18 which is also substantially flattened with the fourth panel 6*b* and first panel 4*a* being substantially coplanar with each other. As mentioned previously, in this first collapsed position, joints 15 and 17 include a 180° bend and constitute the outer corners of the collapsed box.

Box 1 is then moved from the first collapsed position (FIG. 4) into a second collapsed position (FIG. 5) by rotating box 1 in the direction of Arrow F. This causes the panels to move so that joints 16 and 18 are positioned at the outermost corners of box 1. Each joint 16, 18 has a 180° bend therein and each joint 15 and 17 is substantially flattened. By rotating the box along the direction of Arrow F, it can be seen that first hinge 24 and third hinge 26 are moved into a position where they have a 180° bend in them as they wrap around joint 16. Second hinge 25 and fourth hinge 27 also are caused to have a 180° bend as they wrap around joint 18. The forces supplied by hinges 24-27 assure that the top flaps 20A/21A and 20B/21B and the bottom flaps 22A/23A and 23B/22*b* are all held in abutting contact with the exterior surface of the associated panels 4*a*-6*b*. Hinges 24-27 provide sufficient force to assure that the free ends of each of the top and bottom flaps adjacent gaps 29 are also held in abutting contact with the exterior surface of the associated panels 4*a*-6*b*.

When box 1 is in this second collapsed position it is in a configuration that is suitable for shipping. Box 1 in this second collapsed position is of a reduced height relative to the original blank 2. The overall height of box 1 when it is in each of the first and second collapsed positions is H2. In other words, the height of box 1 is substantially equal to the height H2 of the panels 4*a*-6*b* alone. This is due to the fact that the top and bottom flaps have been folded into abutting contact with the exterior surface of the panels 4*a*-6*b*. This arrangement allows the user to more easily ship the box 1 as it is of a diminished size relative to the original blank 2. The overall thickness W of box 1 in the second collapsed condition is equal to the combined thickness of two abutting panels, such as 4*b* and 6*b* and two flaps, such as 21A and 20B. The diminished dimensions of box 1 in the second collapsed condition preferably are one that is suitable for easy insertion of the box into a standard postal mailbag. Additionally, the positioning of hinges 24-27 on the outermost corners presents a box configuration that does not have free edges that can snag or catch on other objects being shipped, mailed or carried in a mailman's bag. Additionally, the diminished dimensions of box 1 when in the first or second collapsed condition also makes it possible to store or display box 1 in a smaller space compared to previously known boxes in which the top and bottom flaps extend outwardly away from and coplanarly with the panels that form the sidewalls and endwalls thereof.

It is often appropriate to provide information such as assembly instructions or the like on a piece of packaging. In accordance with a specific feature of the present invention and referring to FIG. 6, it can be seen that a printer 30 may be utilized to print indicia 32 onto the interior surface "I" of at least one of the top and bottom flaps, such as top flap 21A. Inasmuch as this printed indicia 32 is on the interior surface of top flap 21A, when box 1 is fully erected and moved to the closed position as will be discussed hereinafter, the indicia will be moved to a position disposed in the interior of the box and will not detract from the appearance of the box exterior. It will be understood that instead of printing directly onto the folded blank 2, an adhesive label containing the printed indicia 32 may be applied to the interior surface "I" of one of the top and bottom flaps.

It will be understood that if the printed indicia 32 is a shipping address then that address may be one that is selected from a computerized database of addresses of consumers to whom the folded blanks 2 are to be mailed.

In accordance with a specific feature of the present invention, the printed indicia 32 preferably, but not exclusively, includes a shipping address for a consumer. This shipping address enables the post office or a shipping company to ship the box when in a second collapsed condition (FIG. 6) to a remote consumer.

In accordance with another specific feature of the present invention, it is possible to ship a number of boxes together when in the second collapsed position. This is illustrated in FIG. 6A where three folded blanks 2 are shown in the second collapsed position. The folded blanks are stacked one on top of the other and are banded together by restraining straps 80. A single shipping label, in the form of indicia 32, is applied to one of the flaps on an outermost blank 2. Although not illustrated herein, it will be understood that one or more restraining straps 80 may also be applied around a single folded blank 2 in a position that will ensure the top and bottom flaps do not separate from the exterior surface "E" of panels 4*a*-6*b*. This strap 80 will ensure that no loose corners of the top and bottom flaps become damaged as the folded blank is shipped.

Figure 7:
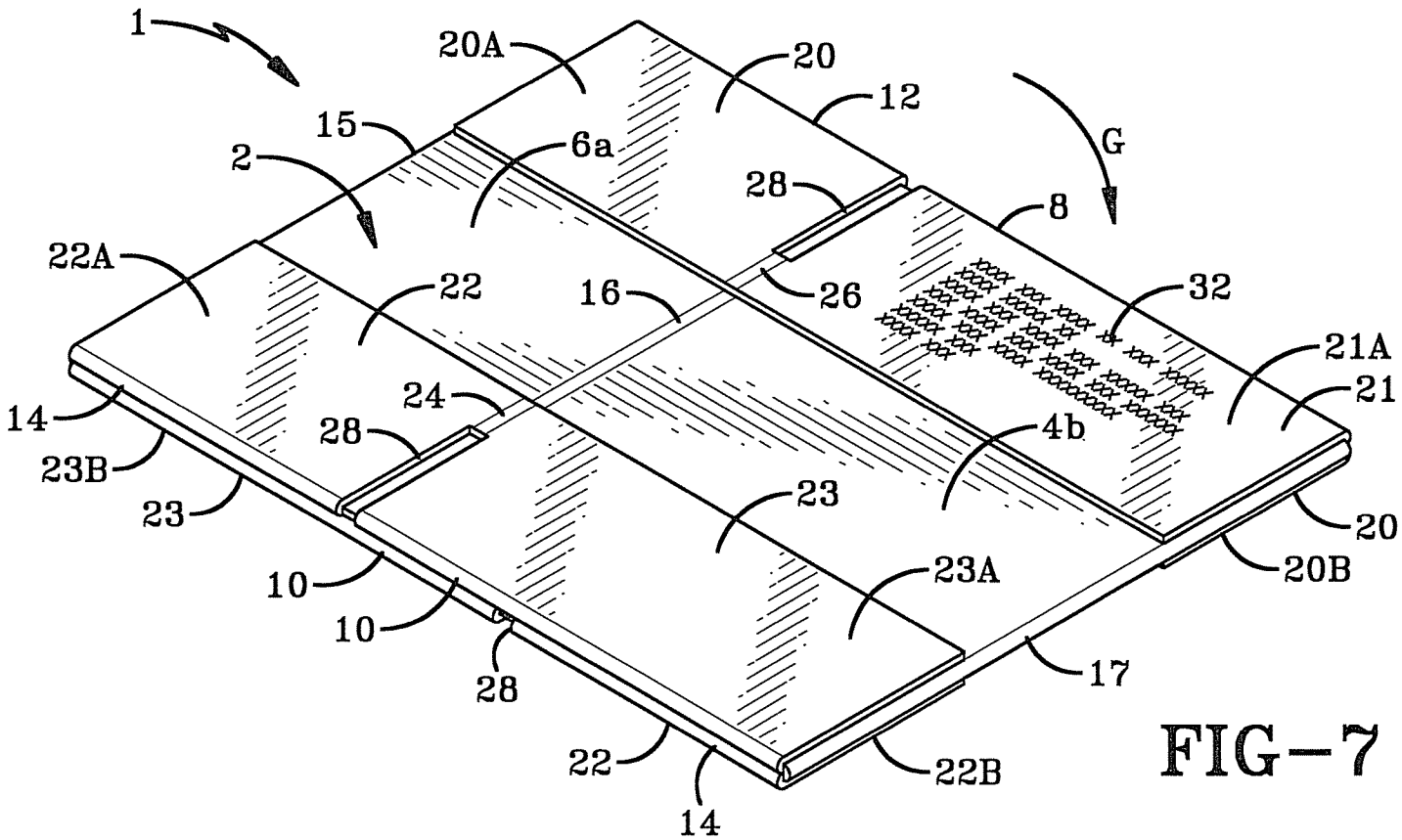
FIG. 7 is a perspective view of the box shown in FIG. 6 moved back to the first collapsed position shown in FIG. 4 for opening.
Figure 8:
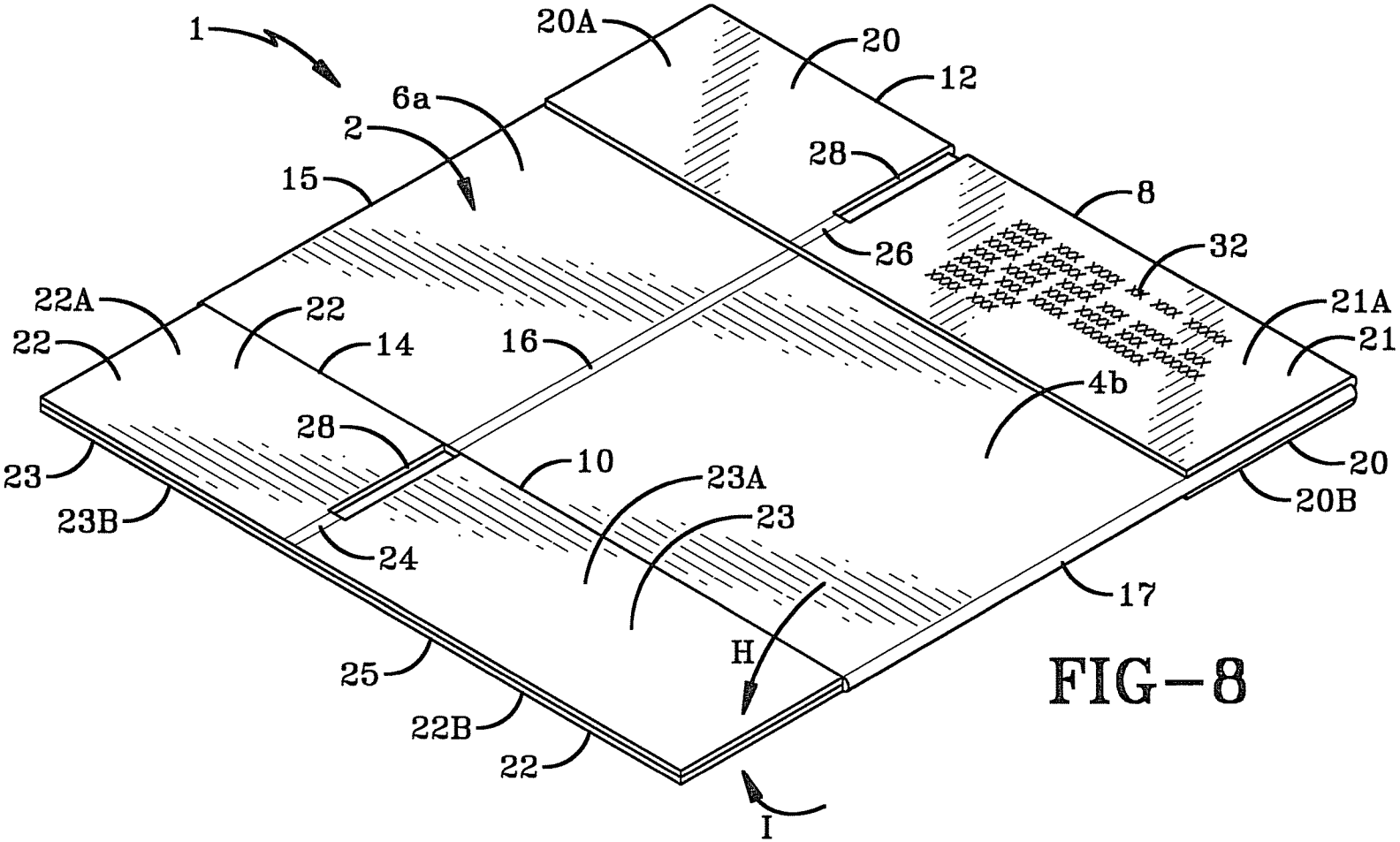
FIG. 8 is a perspective view of the box shown in FIG. 6 with the bottom set of flaps moved to the open position.
Figure 9:
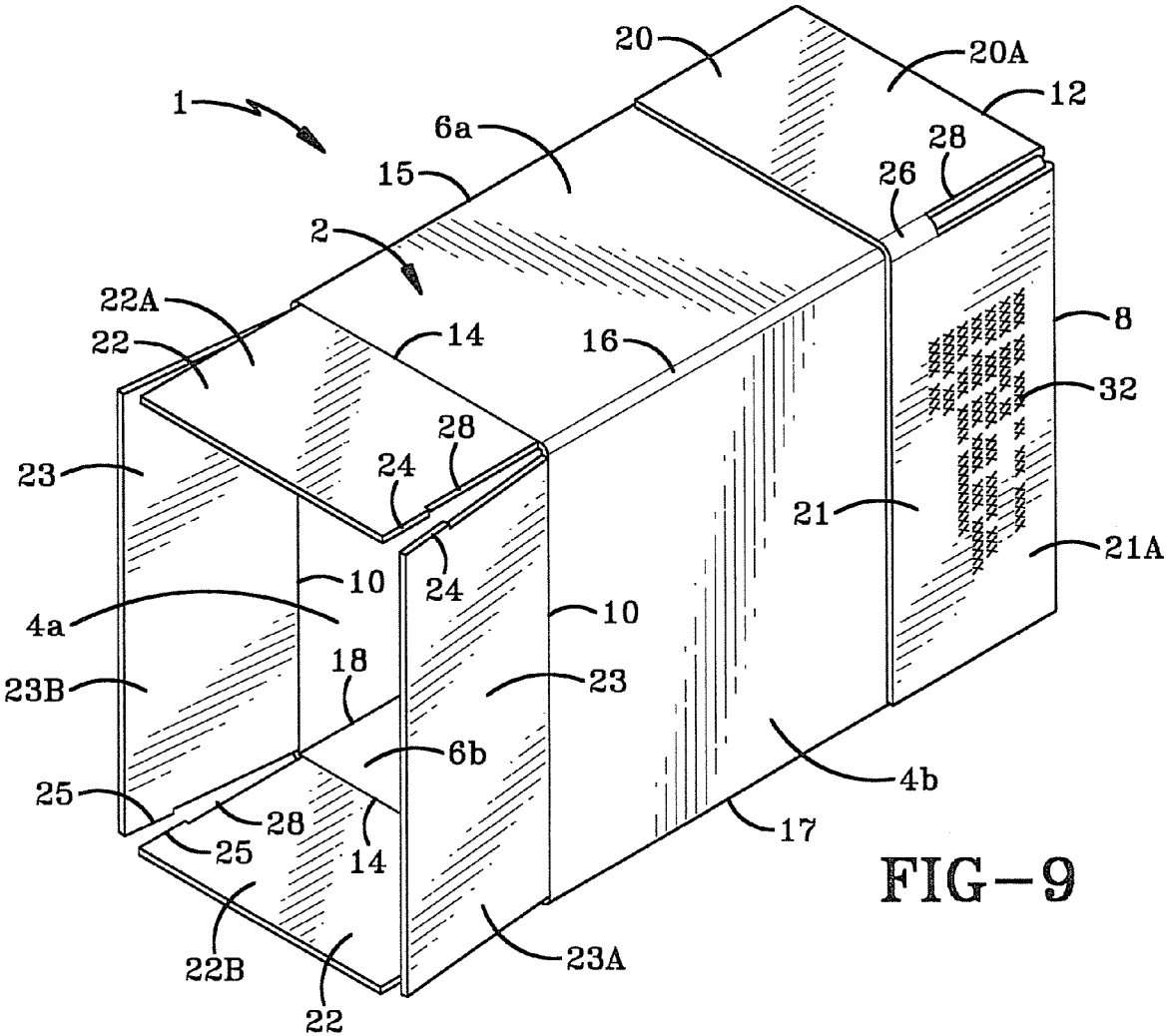
FIG. 9 is a perspective view of the box shown partially constructed.
Figure 10:
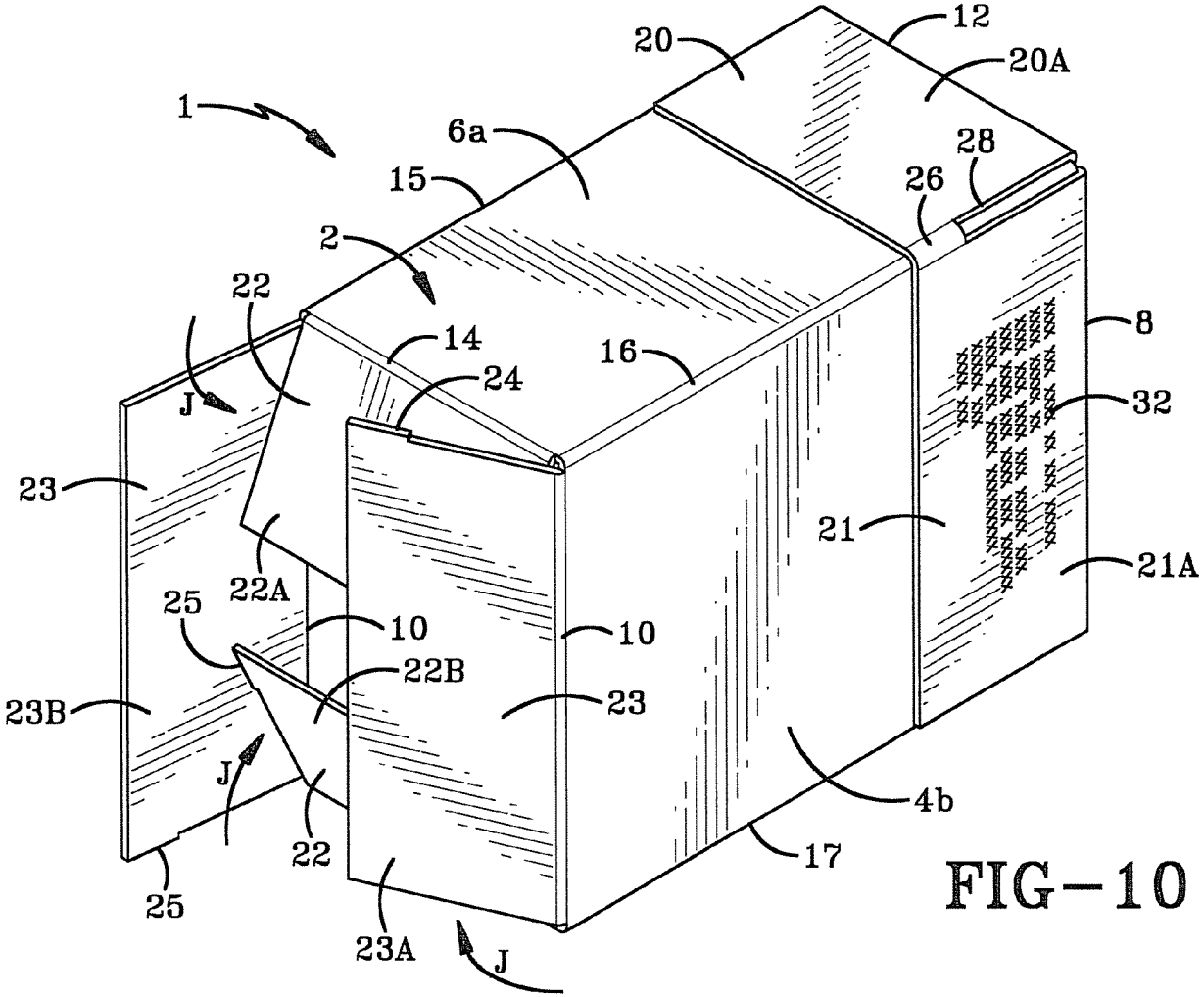
FIG. 10 is a perspective view of the box of FIG. 1 shown with the bottom of the box more fully constructed.

Referring to FIG. 7, the folded blank 2, having been received or purchased by the consumer in the second collapsed position, may now be erected into a position where it is ready for use. The erection of box 1 is accomplished as follows. Firstly, the folded blank 2 is moved from the second collapsed position back to the first collapsed position, i.e., blank 2 is rotated from the position shown in FIG. 7 along the direction indicated by Arrow G to the position shown in FIG. 8. This causes hinges 24-27, which were disposed at the outer corners of the blank in FIG. 7 to be moved away from the outer corners and to a position where they are disposed intermediate the outer corners. In this first collapsed position, flaps 20A and 21A remain in abutting contact with the exterior surface "E" of the associated panels 4*a*-6*b*. Bottom flaps 22B, 22A, 23A, 23B are then rotated downwardly in the direction of Arrows H and I as shown in FIG. 8 to where they once again extend coplanarly with and outwardly away from panels 4*a*-6*b*. Box 1 is then moved to a partially erected state (FIG. 9) with top flaps 21B, 20A, 21A, 20B remaining in abutting contact with the exterior surface "E" of the panels 4*a*-6*b* and with the hinges 26 and 27 intact. Hinges 24 and 25 on bottom flaps 22B, 22A, 23A, 23B are broken apart (FIG. 9). This permits the bottom flaps 22B, 22A, 23A, 23B to be rotated in the direction of Arrows J inwardly toward each other and so as to close off the bottom opening of box 1 (FIG. 10). A suitable sealing mechanism, such as an adhesive or staples is then applied to bottom flaps 22B, 22A, 23A, 23B to fix them in place relative to each other. Box 1 is now in a loadable condition where any desired articles 34 may be introduced into the cavity defined by panels 4*a*-6*b* and bottom flaps 22B, 22A, 23A and 23B. Box 1 may be loaded with articles goods 34 while top flaps 21B, 20A, 21A, 20B remain positioned in abutting contact with the exterior surface "E" of panels 4*a*-6*b*. Top flaps 21B, 20A, 21A and 20B remain in this position as they are held there by hinges 26 and 27.

Figure 11:
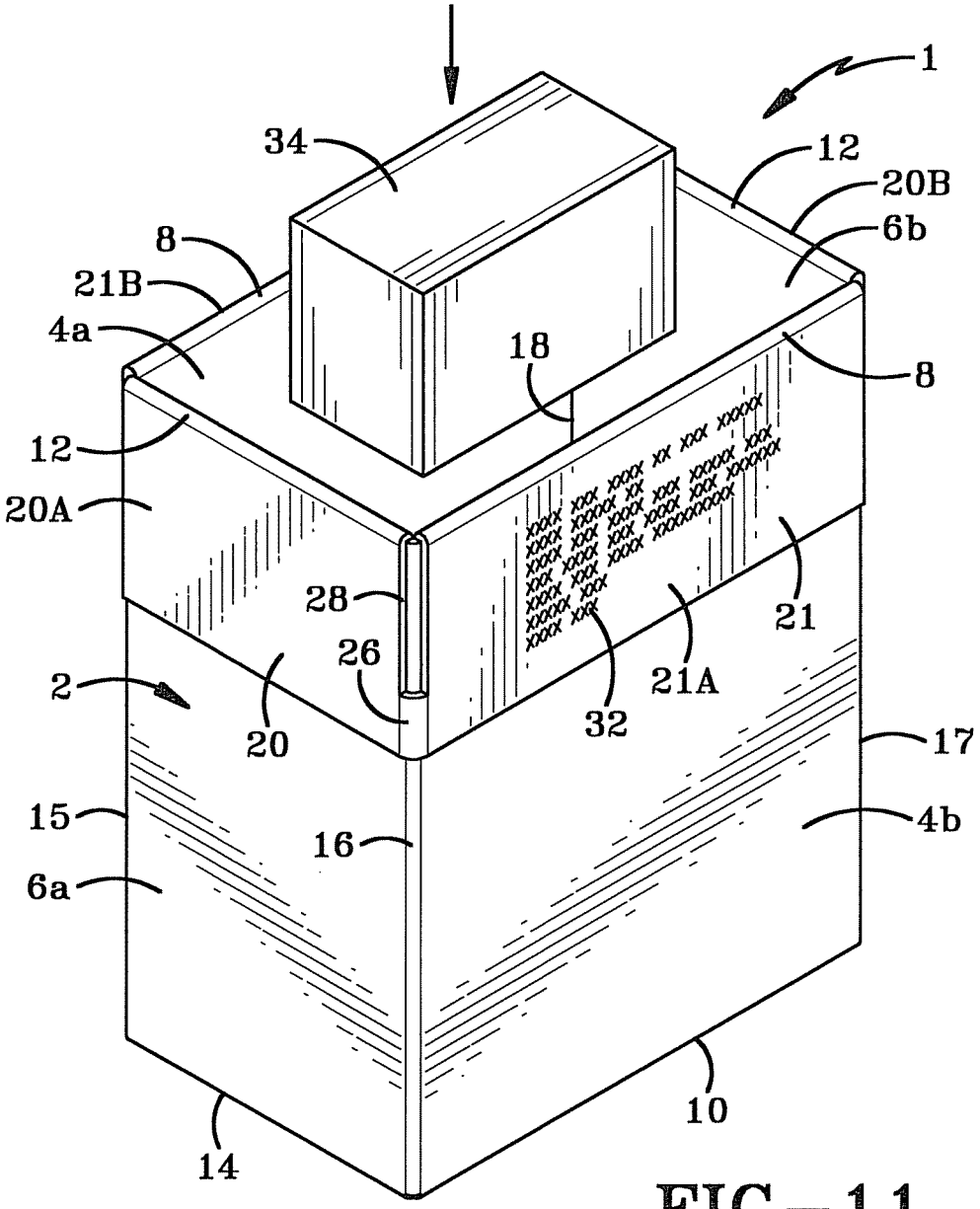
FIG. 11 is a perspective view of the box shown in FIG. 1 fully constructed and with the top flaps in the retained position.
Figure 12:
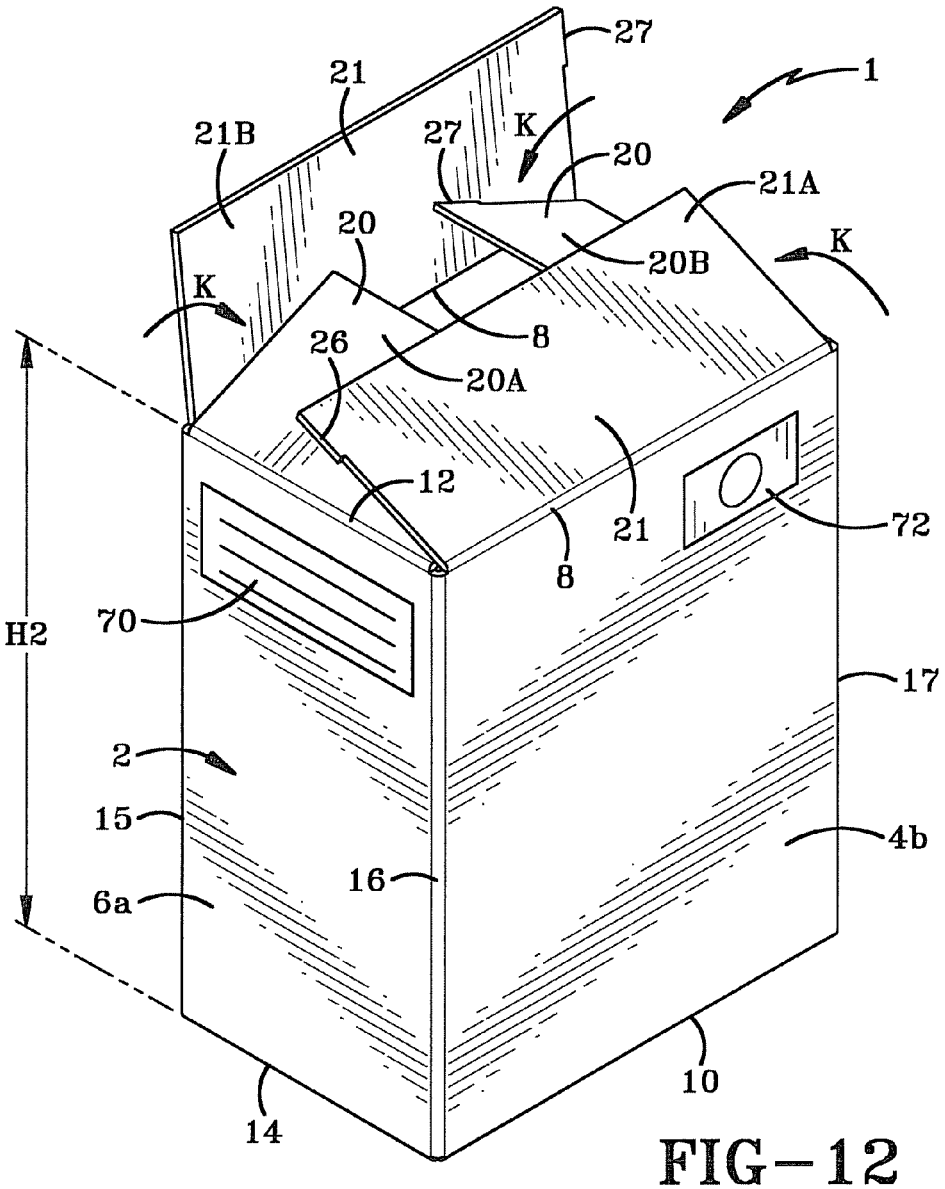
FIG. 12 is a perspective view of the box shown in FIG. 1 with the top flaps moving towards a closed position.

FIG. 11 shows that at this stage, indicia 32 are still visible as the interior surface "I" of top flap 21A upon which the indicia are printed still faces outwardly. Once box 1 is fully loaded, hinge 26 and hinge 27 are broken and top flaps 21B, 20A, 21A, 20B are rotated inwardly toward each other in the directions of Arrows K and into the closed position as shown in FIG. 12. When this occurs, the interior surface "I" of top flaps 21B, 20A, 21A, 20B is disposed within the interior of box 1 and indicia 32 are no longer visible. Thus, the exterior appearance of box is not marred by the indicia 32 once box 1 is closed.

Figure 5:
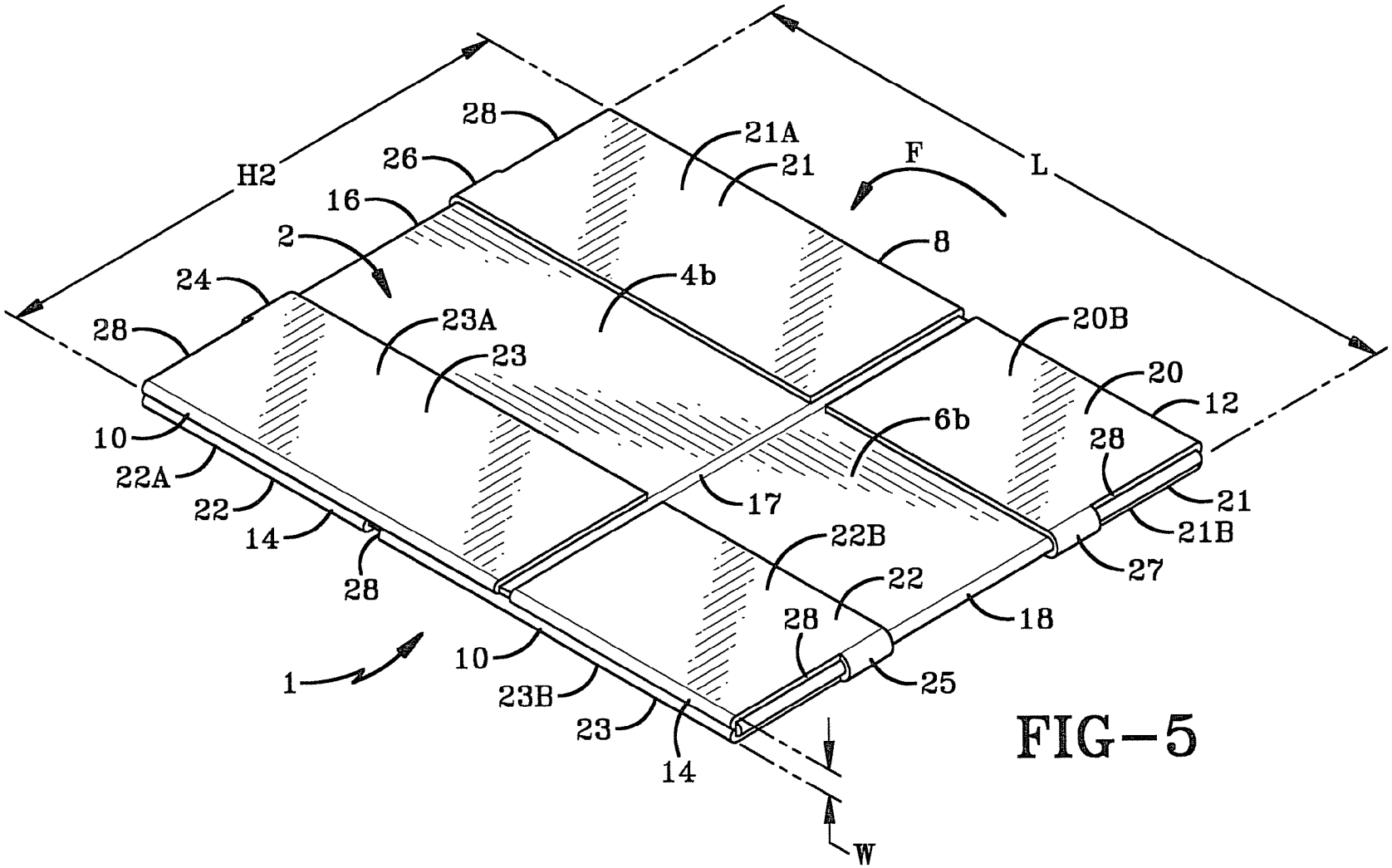
FIG. 5 is a perspective view of the box shown in FIG. 1, with the box rotated into a second collapsed position where the flaps are retained against the body.
Figure 6:
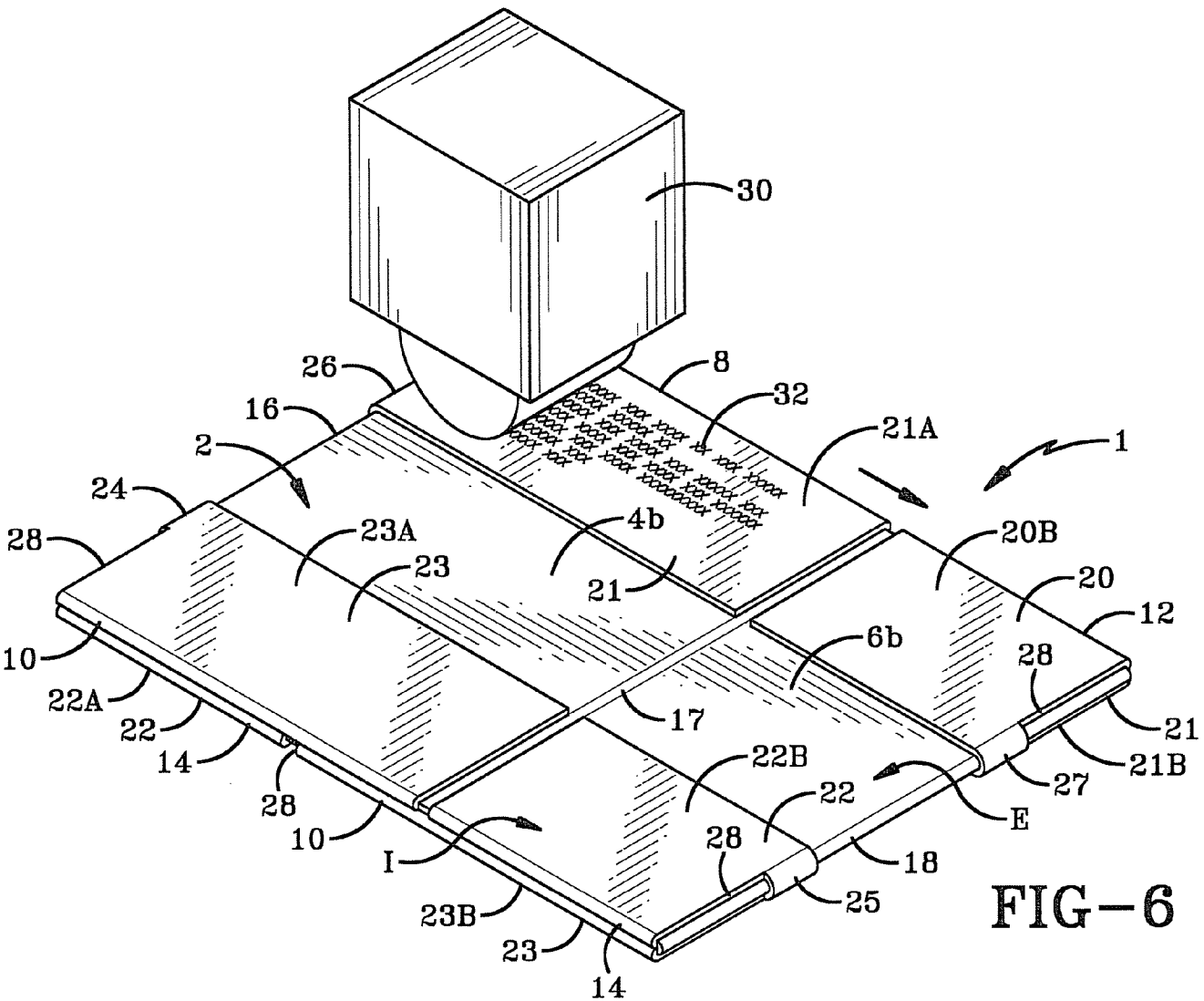
FIG. 6 is a perspective view of the box shown in FIG. 5 with a printer acting thereon.
Figure 6A:
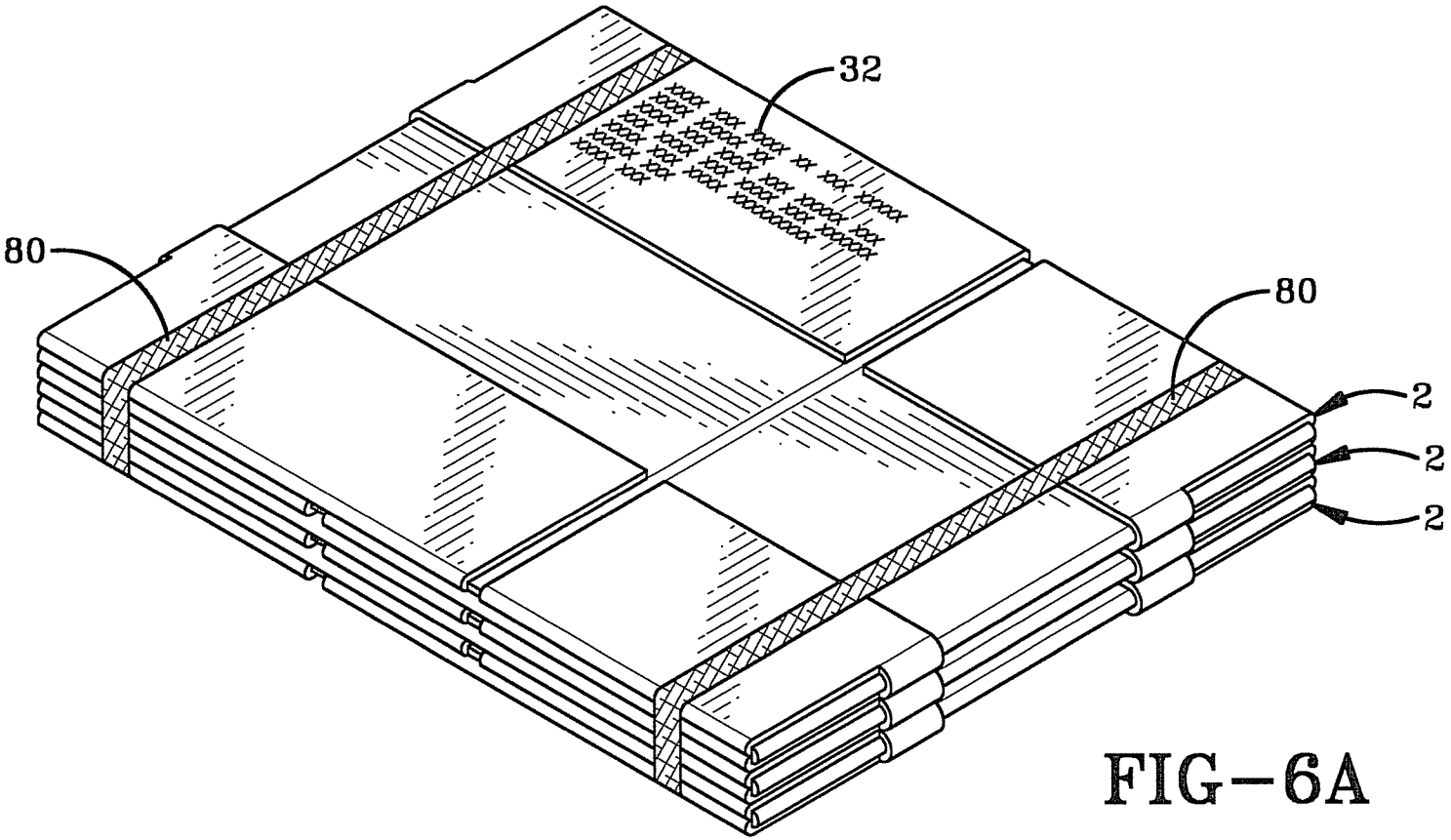
FIG. 6A is a perspective view of a plurality of boxes banded together for shipping.

As is evident from the above description and method of operation, box 1 may be shipped and stored in a relatively small space limited to only to the height H2 of panels 4*a*-6*b* and to the thickness "W" (FIG. 5) and length L of body 2 when in the second collapsed position (FIG. 5 or 6). As is also apparent and in accordance with one of the primary features of the invention, a portion of the interior surface of box 1 may be easily printed with directions or information assuring that when the box is in the closed position, there is no information on the exterior of the box to get in the way of further shipping or packaging. Thus, the folded box 1, shown in FIG. 6, can be shipped to a consumer with the shipping address printed as indicia 32 on the interior surface "I" of one of the flaps. But, once the box 1 is fully erected, loaded and closed, it may be shipped to a second consumer at a remote location without indicia 32 being visible. The shipping address that constituted indicia 32 is no longer visible since the flap containing said indicia has been folded so that the exterior surface of that flap is now visible instead of the interior surface thereof. This removes the likelihood of any confusion as to which is the correct address for delivery of the loaded box. Once the box 1 is fully loaded with articles, the first consumer may write the mailing address of the second consumer onto the mailing label 70 applied to the exterior surface "E" of one of the panels.

While it has been illustrated herein that the blanks 2 are printed with the indicia 32 when in the second folded position, it should be understood that such indicia 32 may be printed on the blank 2 prior to it be folded (i.e. when it is in the position shown in FIG. 1B) or when the blank 2 is in the first folded position (FIG. 4). Preferably, shipping label 70 and decal 72 are applied to blank 2 when it is still a planar sheet (FIG. 1A).

FIG. 1A shows that the distance between the outermost edges 2*a*, 2*b* of blank is the first height identified as H1 and the distance between the two horizontal fold lines 3 is identified as the height H2, with H2 being smaller than H1. As seen from FIGS. 5 and 12, the height of both the shipped box (FIG. 5) and the erected box (FIG. 12) is H2, i.e., the height of the panels 4*a*-6*b*. This is in contrast to previously known erectable boxes where the height of the shipped box would be the equivalent of the height H1 and the height of the previously known erected box would be the equivalent of the height H2. The present inventor has therefore found a way to reduce the overall size of a shipping box to substantially the same height as the erected box and not substantially the height of the blank as was previously the case. This arrangement reduces the mailing cost for collapsed boxes sent through the regular mail as the postage rates are at least partially determined by the overall dimensions of the article shipped.

There is thus disclosed a method of shipping products comprising:

mailing a collapsed box 10 through the mail to a first location at a non-flat postage rate;

erecting the collapsed box 10 at the first location;

loading the products 34 to be shipped into the erected box 34; and mailing the loaded box 34 to a remote second location at a flat postage rate.

The steps of mailing the collapsed box 34 and mailing the loaded box 34 each further include the step of inserting the box into a standard size mail carrier's bag (not shown).

The step of mailing a collapsed box 10 as previously disclosed is preceded by the steps of providing a box 34 that has four side panels 4, 6, each panel having a top edge 8, 12 and a bottom edge 10, 14 with a top flap 20, 21 extending outwardly from the top edge and a bottom flap 22, 23 extending outwardly from the bottom edge; and wherein each panel 4, 6 is of a first height H2 as measured between the top and bottom edges thereof. When the box 10 is collapsed for mailing it has a height that is equal to the first height H2.

Furthermore, the step of collapsing the box 10 includes the steps of folding the top flaps 20, 21 downwardly into contact with an exterior surface of the side panels 4, 6; folding the bottom flaps 22, 23 upwardly into contact with the exterior surface of the side panels 4, 6; and moving the box 10 to a collapsed condition where a hinge 26, 27 that connects two adjacent top flaps or a hinge 24, 25 that connects two adjacent bottom flaps together is disposed on an outermost corner of the box 10.

The step of mailing the collapsed box to the first location is preferably further preceded by the step of applying a flat-rate postage decal 72 to one of the side panels 4, 6 of the box 10 prior to collapsing the box for mailing.

The step of mailing the box 10 to a second location further includes the step of applying a mailing label 32 to an outwardly facing interior surface of one of the folded top and bottom flaps 20, 21, 22, 23.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of shipping products comprising:

providing a box that has four side panels, each panel having a top edge and a bottom edge with a top flap extending outwardly from the top edge and a bottom flap extending outwardly from the bottom edge; and wherein each panel is of a first height as measured between the top and bottom edges thereof; and collapsing the box for mailing so that, when collapsed, the box has a height that is equal to the first height; and wherein the step of collapsing the box further includes:

folding the top flaps downwardly through 180° relative to the side panels and thereby into contact with an exterior surface of the side panels;

folding the bottom flaps upwardly through 180° relative to the side panels and thereby into contact with the exterior surface of the side panels;

mailing the collapsed box through the mail to a first location at a non-flat postage rate;

erecting the collapsed box at the first location;

loading the products to be shipped into the erected box; and mailing the loaded box to a remote second location at a flat postage rate.

2. The method of shipping products as defined in claim 1, wherein the steps of mailing the collapsed box and mailing the loaded box each further include the step of inserting the box into a standard size mail carrier's bag.

3. The method of shipping products as defined in claim 1, wherein the step of collapsing the box further includes the step of:

moving the box to a collapsed condition where a hinge that connects two adjacent top flaps or two adjacent bottom flaps together is disposed on an outermost corner of the box.

4. The method of shipping products as defined in 3, wherein the step of mailing the box to a second location further includes the step of:

applying a mailing label to an outwardly facing interior surface of one of the folded top and bottom flaps.

5. The method of shipping products as defined in claim 1, wherein the step of mailing the collapsed box to the first location is preceded by the step of applying a flat-rate postage decal to one of the side panels of the box prior to collapsing the box for mailing to the first location.

6. The method as defined in claim 1, wherein after the step of folding each of the top and bottom flaps through 180°, the top and bottom flaps are disposed parallel and adjacent to the side panels.

7. A method of forming, shipping and erecting a box, comprising the steps of:

providing a substantially planar blank having a plurality of foldlines thereon configured to permit the blank to be erected into the box; wherein said foldlines divide the blank into a plurality of panels each having a top edge and a bottom edge with a top flap extending outwardly away from the top edge and a bottom flap extending outwardly away from the bottom edge; and wherein the blank is of a first height as measured between an outermost edge of the top flap and an outermost edge of the bottom flap; and wherein the panels are of a second height as measured between the top and bottom edges thereof; and the first height is greater than the second height;

securing a first and second side portion of the blank together to form a substantially continuous member;

folding the blank into a first collapsed condition where a gap between a pair of adjacent top flaps and a gap between a pair of adjacent bottom flaps falls on an outermost corner of the folded blank;

folding each of the top and bottom flaps through 180° from a first position where the top and bottom flaps are coplanar with the side panels of the blank into a second position where the top and bottom flaps are in abutting contact with an exterior surface of one of the panels; whereby the blank is of the second height;

moving the blank from the first collapsed position to a second collapsed position wherein one of a first hinge that connects a pair of adjacent top flaps together and a second hinge that connects a pair of adjacent bottom flaps together falls on the outermost corner of the folded blank, and the blank in this second collapsed position is of the second height;

retaining each top flap and each bottom flap in abutting contact with the side panels:

shipping the blank to a remote location in the second collapsed position at a non-flat postage rate;

erecting the blank to form a box;

placing goods to be shipped within the erected box; and mailing the erected box containing the goods to a second location at a prepaid-flat postage rate.

8. The method as defined in claim 7 further comprising the step of:

applying a shipping label with a shipping address thereon to an interior surface of one of the top flaps and bottom flaps.

9. The method as defined in claim 8, wherein the step of applying a shipping label includes the step of:

printing the shipping address on the interior surface of the one of the top and bottom flaps.

10. The method as defined in claim 9, wherein the step of printing the shipping address includes the step of:

passing the blank beneath a print head.

11. The method as defined in claim 10, wherein the step of printing the shipping address includes the step of:

passing the blank beneath the print head when the blank is in one of the first and second collapsed positions.

12. The method as defined in claim 8, wherein the step of shipping the folded blank in the second collapsed position includes the step of:

depositing the folded blank into the mail for shipping thereof to the shipping address.

13. The method as defined in claim 8, further comprising the step of:

applying erecting and shipping instructions on the interior surface of another of the top and bottom flaps.

14. The method as defined in claim 8, further comprising the step of:

applying a prepaid postage decal on an exterior surface of one of the panels, top flaps and bottom flaps in an area to be covered by the top and bottom flaps when the blank is folded in either of the first and second collapsed positions.

15. The method as defined in claim 7, further comprising the step of:

applying a retaining strap around the folded blank when in the second collapsed position.

16. The method as defined in claim 7, further comprising the steps of:

erecting the box; and wherein the step of erecting the box includes the steps of:

breaking the second hinge;

moving the folded blank from the second collapsed position to an erected position where the panels are oriented in a substantially rectangular pattern relative to each other;

rotating the bottom flaps out of abutting contact with the exterior surface of the panels;

rotating the bottom flaps inwardly toward each other to close off access to an opening in a bottom end of the erected blank;

securing the bottom flaps to each other to seal off access to the opening in the bottom end; whereby the box is in a loading condition and is able to retain articles in an interior cavity defined by the panels and the bottom flaps.

17. The method as defined in claim 16, further comprising the steps of:

breaking the first hinge;

rotating the top flaps out of abutting contact with the exterior surface of the panels;

rotating the top flaps inwardly toward each other to close off access to an opening in a top end of the box;

securing the top flaps to each other to seal off access to the opening in the top end.

18. The method as defined in claim 17, further comprising the step of:

applying a mailing label to the exterior surface of one of the panels, top flaps and bottom flaps.

19. The method as defined in claim 18, wherein the step of applying a mailing label to the box includes the step of printing at least one mailing label area on the exterior surface of one of the panels, top and bottom flaps; said mailing label area including a plurality of spaced apart horizontal lines for filling in of a mailing address thereon.

20. The method as defined in claim 19, further comprising the step of:

depositing the loaded box into the mail for mailing to the mailing address on the mailing label.

21. The method as defined in claim 18, wherein the step of applying a mailing label to the box includes:

sticking a mailing label containing a mailing address thereon onto the exterior surface of one of the panels, top flaps and bottom flaps.

22. The method as defined in claim 21, further comprising the step of:

depositing the loaded box into the mail for mailing to the mailing address on the mailing label.

23. The method as defined in claim 18, wherein the height and thickness of the folded blank in the collapsed condition are small enough to fit easily within an interior of a standard delivery bag for a mail carrier.

24. The method as defined in claim 7, wherein the step of shipping the folded blank further comprises the steps of:

assembling a plurality of substantially identical blanks in a vertical stack, where each of the blanks is in the second folded position; and securing the stack of blanks together prior to shipping.

25. The method as defined in claim 24, wherein the step of securing the stack of blanks together comprises the step of wrapping at least one retaining strap around the stack thereof.

26. The method as defined in claim 7, further comprising the step of:

printing indicia onto one or both of an interior surface and an exterior surface of the blank.

27. The method as defined in claim 26, wherein the step of printing indicia precedes one or both of the steps of securing the first and second side portions of the blank together and folding the blank into the first collapsed position.

28. The method as defined in claim 26, wherein the step of printing indicia includes the steps of:

printing first indicia onto the exterior surface of the blank prior to one or both of the steps of securing the first and second side portions of the blank together and folding the blank into the first collapsed position; and printing second indicia onto an outwardly facing region of the interior surface of the blank after the step of folding the blank into the first collapsed position.

* * * * *